United States Patent [19]

Gorham

[11] 3,960,312

[45] June 1, 1976

[54] DIE CUT CONTAINER

[75] Inventor: Jack C. Gorham, Keokuk, Iowa

[73] Assignee: Hoerner Waldorf Corporation, St. Paul, Minn.

[22] Filed: Aug. 25, 1975

[21] Appl. No.: 607,715

[52] U.S. Cl. ..... 229/37 R; 229/14 R

[51] Int. Cl.[2] ..... B65D 5/02

[58] Field of Search ..... 229/37 R, 38

[56] References Cited

UNITED STATES PATENTS

| | | | |
|---|---|---|---|
| 3,114,494 | 12/1963 | Wasyluka | 229/37 R |
| 3,189,249 | 6/1965 | Fallert | 229/37 R |
| 3,190,533 | 6/1965 | Larson | 229/37 R X |
| 3,281,050 | 10/1966 | Suchadolski | 229/37 R |
| 3,310,221 | 3/1967 | Duncan | 229/37 R |
| 3,346,169 | 10/1967 | Palle | 229/37 R |
| 3,360,181 | 12/1967 | Wilson | 229/37 R |
| 3,371,844 | 3/1968 | Perrella | 229/37 R |
| 3,556,385 | 1/1971 | Kato | 229/37 R |

*Primary Examiner*—Davis T. Moorhead
*Attorney, Agent, or Firm*—Jerry F. Best

[57] ABSTRACT

A die cut blank which, when folded and glued, has a four panel rectangular member removably attached along one edge thereof which may be torn off and inserted as a wall liner into the assembled carton to provide a carton having double wall thicknesses for improved strength and rigidity.

2 Claims, 4 Drawing Figures

DIE CUT CONTAINER

BACKGROUND OF THE INVENTION

1. Field of the Invention

This invention relates to a blank for making a reinforced container with double thickness side wall where the double thickness side walls serve as a reinforcing liner for the carton.

2. Description of the Prior Art

There are many uses for cartons having reinforced side walls and a common structure for accomplishing this is to have a double thickness of material extending around the inside perimeter of the carton. It is desirable to have a one-piece blank which can be erected into the lined container so that the user of the container will not have to coordinate inventories of two separate items prior to assembly. Examples of one-piece blanks which may be folded into containers having lined side walls may be found in the following patents:

U.S. Pat. No. 3,346,169 to Palle, issued Oct. 10, 1967.

U.S. Pat. No. 3,360,181 to Wilson, issued Dec. 26, 1967.

U.S. Pat. No. 3,114,494 to Wasyluka, issued Dec. 17, 1963.

U.S. Pat. No. 3,189,249 to Fallert, issued June 15, 1965.

U.S. Pat. No. 3,190,553 to Larson, issued June 22, 1965.

U.S. Pat. No. 3,310,221 to Duncan, issued Mar. 21, 1967.

The last four patents listed above are complex die cut arrangements which involve the use of substantially more material than that which would be required to simply line the four side walls of the container. Also a double folding procedure would be required since the blank must be folded first along its length and then along one of the fold lines for purposes of gluing the blank. The Palle design is one which required considerable skill in folding and which does not give a conventional closure on either end as a result. The Wilson design is one which has weakened members connecting the adjacent open ends and serving as a manufacturer's joint and which must, therefore, require manual stitching at the manufacturer's joint. There is a need for a simplified design for a blank which may be erected into a lined container which may be folded and glued on conventional equipment, which uses no excess board, and which is simple to erect prior to use.

SUMMARY OF THE INVENTION

A four panel blank with bottom closure flaps attached to the bottom edges of each of the adjacent side wall panels, and top closure flaps attached to the top edges of each of the side panels with a series of four liner panels extending along the top of the blank and removably attached to three of the top cover flaps, the fourth flap being separate and having a manufacturer's glue flap attached along its outer edge in line with a manufacturer's glue flap on the sie wall panel directly below.

DETAILED DESCRIPTION OF THE PREFERRED EMBODIMENT

Figure 1:
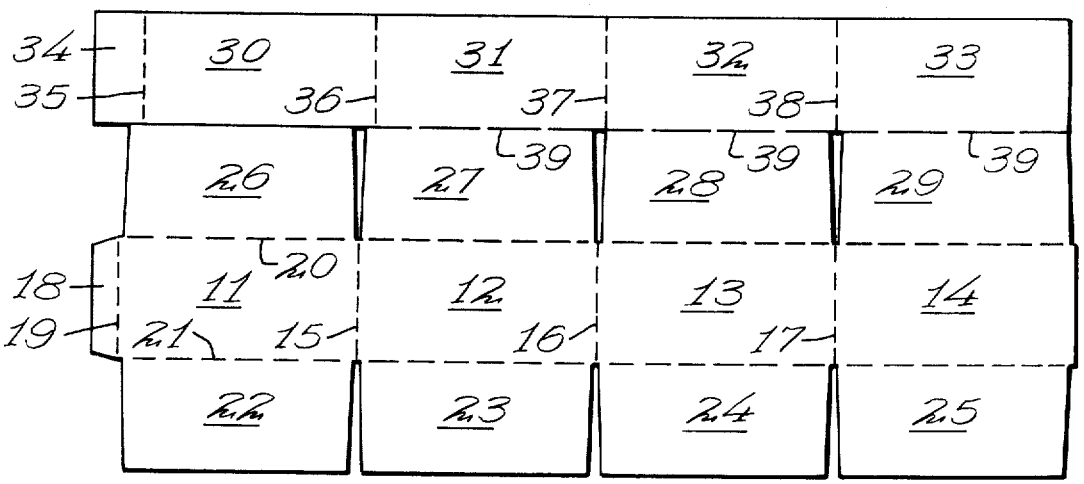
FIG. 1 is a plan view of a blank embodying the present invention.

The present invention is for a blank, shown generally as 10 in FIG. 1 which is made of corrugated paperboard or similar stiff, yet foldable sheet-like material and includes four rectangular side wall panels 11, 12, 13 and 14 which are hingedly connected along vertical fold lines 15, 16 and 17. Along a first lateral edge of the blank and attached to the side wall panel 11 is a manufacturer's glue flap 18 which is connected to the side wall panel 11 by a fold line 19.

The top and bottom edges of the four side wall panels are defined by two parallel, horizontal fold lines 20 and 21 respectively hingedly connected to each of the four side wall panels along the bottom fold line 21 is a bottom closure flap, which are seen as 22, 23, 24 and 25. Top closure flaps 26, 27, 28 and 29 are hingedly attached along the top edge of the respective side wall panel by the fold line 20. These side wall panels and closure flaps together comprise a standard rectangular, tubular, rigid-sided container.

The liner for this container is attached to the blank and consists of four liner panels which are formed in height substantially equal to the height of the wall panels 11 through 14 and formed in length a distance sufficient to allow them to be placed on the inside perimeter of the container after it is erected. The liner includes panels 30, 31, 32 and 33 with a manufacturer's joint 34 hingedly attached along a vertical fold line 35 to one lateral edge of the liner and the liner panel 30. The four liner panels are hingedly connected by vertical fold lines 36, 37 and 38, however, only the panels 31, 32 and 33 are connected to the adjacent top cover panels 27, 28 and 29. This connection is made along a weakened line of separation which is shown as 39 and allows those panels to be removed by breaking loose the panels along the line of separation. The fourth panel 30 is not connected to the adjacent top cover flap 26 since when the blank is folded, the top cover flap 26 and the liner panel 30 must move independently of one another because the respective fold lines about which they move, 15 and 36, are not colinear with one another as may be seen in FIG. 1.

Figure 3:
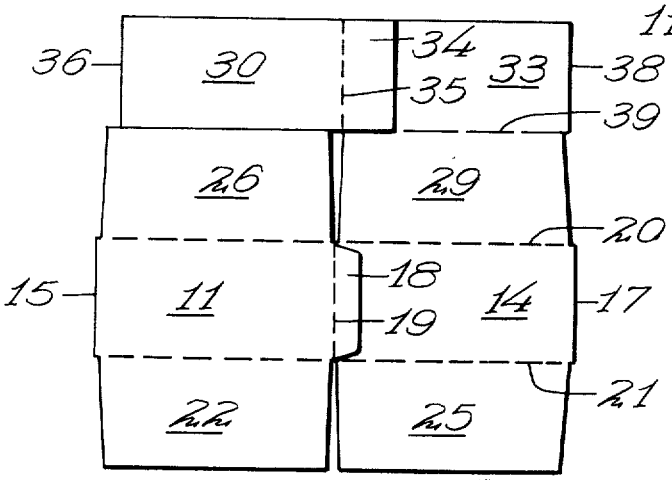
FIG. 3 is a plan view of the blank shown in FIG. 1 folded and glued.

The top cover flaps 26 through 29 are separated in the die cutting process and since the overall perimeter of the four liner panels 30 through 33 must be slightly less than that of the four side wall panels 11 through 14, if the right hand fold lines 38 and 17 are positioned in alignment as shown, then the other pairs of fold lines must be increasingly staggered to provide a liner which will fit properly within the carton. The folding and gluing step is carried out with the right hand set of panels being folded inwardly about the fold lines 17 and 38 and the left hand panels being folded inwardly about the fold lines 15 and 36. This may be done on standard in-line folding and gluing equipment and the two manufacturer's glue flaps 34 and 18 are then placed into contact with the outer surfaces of the respective flaps 33 and the panel 14 as shown in FIG. 3.

Figure 2:
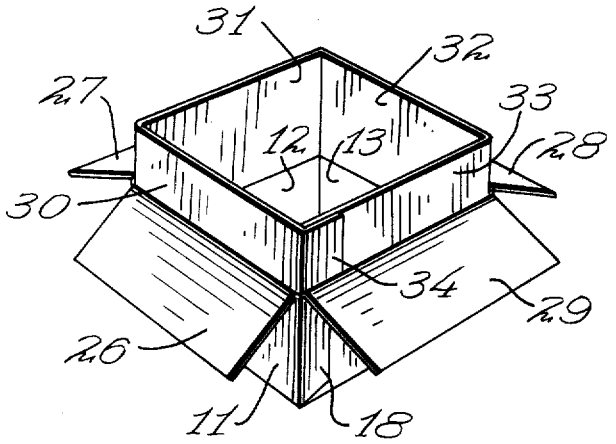
FIG. 2 is a perspective view of a container, partially assembled, erected from a blank similar to that shown in FIG. 1 and embodying the present invention.
Figure 4:
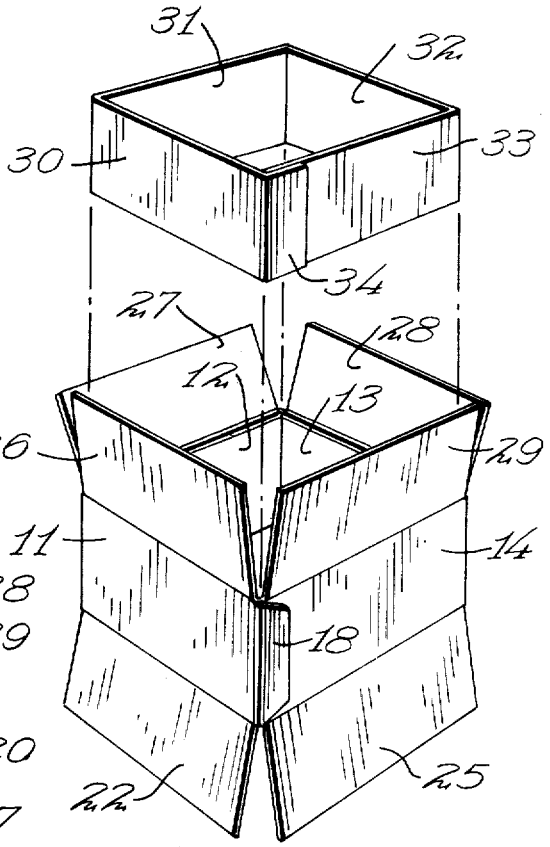
FIG. 4 is a view in perspective with the liner separated from the carton illustrating the assembly of the carton shown in FIG. 2.

FIG. 4 shows how the carton is moved into relationship and how the top four panel liner members may be removed for insertion within the carton as shown in FIG. 2.

I claim:

1. A die-cut blank made from foldable sheet material, said blank adapted to be folded into a rigid sided container having top closure flaps and a liner around the inside of the walls of the container, said liner formed as a removable portion of said blank, said blank comprising:

four substantially rectangular side wall panels arranged in side-by-side relationship and hingedly connected to one another along three vertically oriented fold lines;

a manufacturer's glue flap hingedly attached along a vertical fold line to a first lateral edge of a first of said side walls;

top closure flaps arranged along the top edge of said side wall panels, each of said top cover flaps being hingedly attached to the respective adjacent side wall panel along a horizontal fold line defining the top edges of said side wall panels;

four liner panels hingedly attached to one another and located along the top edge of said top closure flaps, a first of said liner panels positioned said first side wall being unconnected to the top closure flap adjacent said first side wall, each of the remaining three of said liner panels being removably attached to the respective adjacent top closure flap.

2. The blank of claim 1, including a manufacturer's glue flap hingedly attached to one lateral edge of said first liner panel.

* * * * *